US012178339B2

(12) United States Patent
Tong

(10) Patent No.: US 12,178,339 B2
(45) Date of Patent: Dec. 31, 2024

(54) PORTABLE TABLEWARE SUITE HAVING FOLDABLE AND COMBINABLE TABLEWARE

(71) Applicant: Yue Hang Eric Tong, Hong Kong (CN)

(72) Inventor: Yue Hang Eric Tong, Hong Kong (CN)

( * ) Notice: Subject to any disclaimer, the term of this patent is extended or adjusted under 35 U.S.C. 154(b) by 0 days.

(21) Appl. No.: 17/767,910

(22) PCT Filed: Jun. 3, 2021

(86) PCT No.: PCT/CN2021/098035
§ 371 (c)(1),
(2) Date: Apr. 10, 2022

(87) PCT Pub. No.: WO2021/254156
PCT Pub. Date: Dec. 23, 2021

(65) Prior Publication Data

US 2024/0081565 A1 Mar. 14, 2024

(30) Foreign Application Priority Data

Jun. 16, 2020 (CN) ..... 202021115564.7

(51) Int. Cl.
*A47G 21/02* (2006.01)
*A47G 21/06* (2006.01)
*A47G 21/00* (2006.01)

(52) U.S. Cl.
CPC ..... *A47G 21/02* (2013.01); *A47G 21/06* (2013.01); *A47G 2021/002* (2013.01)

(58) Field of Classification Search
CPC ... A47G 21/02; A47G 21/06; A47G 2021/002
USPC ..... 30/123, 142–150
See application file for complete search history.

(56) References Cited

U.S. PATENT DOCUMENTS

2015/0157152 A1* 6/2015 Dai ..... A47G 21/06 30/147
2015/0257562 A1* 9/2015 Miksovsky ..... B67B 7/16 206/553
2019/0365128 A1* 12/2019 Pepper ..... A47G 21/103
2020/0138214 A1* 5/2020 Choudhry ..... A47G 21/06

* cited by examiner

*Primary Examiner* — Phong H Nguyen

(57) ABSTRACT

A portable tableware suite having foldable and combinable tableware includes a box body; a fixing plate located within the box body for limiting and avoiding the tableware from moving in the box body; the tableware, which is at least one member selected from the group consisting of a knife, a fork and a spoon, fixed on the fixing plate; and at least one limit part located on the fixing plate for engaging with the tableware. The fork and the spoon are foldable when in use and are flat while the fixing plate is fixed. The tableware such as flat knife, fork and spoon is fixed on the fixing plate, and then is stored in the box body; the fixing plate is easy to be put in or taken out of the box body.

15 Claims, 6 Drawing Sheets

PORTABLE TABLEWARE SUITE HAVING FOLDABLE AND COMBINABLE TABLEWARE

CROSS REFERENCE OF RELATED APPLICATION

This is a U.S. National Stage under 35 U.S.C 371 of the International Application PCT/CN2021/098035, filed Jun. 3, 2021, which claims priority under 35 U.S.C. 119 (a-d) to CN 202021115564.7, filed Jun. 16, 2020.

BACKGROUND OF THE PRESENT INVENTION

Field of Invention

The present invention relates to the field of tableware technology, and more particularly to a portable tableware suite which is able to store a variety of foldable tableware, and is small in size after the tableware is stored.

Description of Related Arts

Due to the particularity, it is necessary for tableware to keep clean and hygienic. In order to dine in non-fixed places, such as outdoors, or while traveling, it is usually necessary to carry tableware by oneself. While carrying non-disposable tableware such as knives, forks, spoons and chopsticks, a round or oval box body is generally used. Because the tableware is not flat, the box body is relatively large, and more space is occupied while carrying the tableware; and moreover, all kinds of tableware are not fixed in the box body, they are collided with each other and make noise while moving, so they are difficult to be carried. While carrying disposable tableware, disposable forks, disposable spoons and disposable tissue are put in the disposable plastic bag of commonly seen takeaway food. It is well known that the disposable tissue is not hygienic, when the disposable tissue is in contact with the disposable tableware, most disposable tableware is made of low-grade plastic, and there is a risk of contaminating the surface of tableware. The tableware provided by the present invention is made of edible-grade plastic, which is hygienic and safe. At the same time, the tableware is packed by plastic. not only large in size, but also not environmentally friendly. This tableware provided by the present invention is able to raise public awareness of environmental protection and reduce the use of disposable plastics.

SUMMARY OF THE PRESENT INVENTION

In order to solve the above problems, an object of the present invention is to provide a portable tableware suite having foldable and combinable tableware, which is able to store multiple foldable and fixed tableware, occupies less space, is small in size and easy to carry.

To achieve the above object, the present invention provides technical solutions as follows.

A portable tableware suite having foldable and combinable tableware comprises a box body; a fixing plate located within the box body for limiting and avoiding the tableware from moving in the box body; the tableware, which is at least one member selected from the group consisting of a knife, a fork and a spoon, fixed on the fixing plate; and at least one limit part located on the fixing plate for engaging with the tableware. The tableware such as knives, forks and spoons is fixed on the fixing plate, and then is accommodated within the box body. The fixing plate is easy to be put in or taken out of the box body. In the process of carrying, because the tableware is fixed by the limit part, the tableware will not contact each other, thereby avoiding the noise caused by mutual collision. Moreover, the tableware will not move out of position, hindering the opening and closing of the box body. The tableware is fixed on the fixing plate, is compact in structure, occupies less space, so that the box body is small in size and the tableware suite is convenient to carry.

Preferably, the tableware comprises the knife, the fork and the spoon, there are three limit parts on the fixing plate which are respectively a first limit part for engaging with the knife, a second limit part for engaging with the fork and a third limit part for engaging with the spoon.

Specifically, according to various shapes and sizes of the tableware, the knife and the spoon are arranged on one surface of the fixing plate, the fork is arranged on another surface of the fixing plate; each of the first limit part and the third limit part comprises two limit pieces, two edges of each of the knife and the spoon are respectively inserted into the two limit pieces; the fork is arranged on another surface of the fixing plate, the second limit part comprises two limit pieces, two edges of the fork are respectively inserted into the two limit pieces.

To reduce the size of the tableware, it is necessary to combine the tableware as much as possible for further reducing the size of the tableware suite. Accordingly, the tableware suite further comprises two square strip handles which are detachably connected with a handheld end of the knife, the fork and the spoon for extending a handheld part of the tableware to convenient to use.

There are two limit pieces and a T-shaped limit piece on the another surface of the fixing plate where the second limit part is located for fixing the two handles, wherein the T-shaped limit piece is located between the two limit pieces on the another surface of the fixing plate, the two limit pieces and the T-shaped limit piece on the another surface of the fixing plate are arranged in a row and form two fourth limit parts, the two handles are parallel to each other, two edges of each of the two handles are respectively inserted into the two limit pieces and the T-shaped limit piece on the another surface of the fixing plate, a distance between the T-shaped limit piece and the two limit pieces on the another surface of the fixing plate is basically equal to a width of the two handles, so that the two handles are fixed to avoid the movement on the fixing plate, and it is convenient for placing and taking the two handles.

To be detachably connected with the knife, the fork and the spoon, one end of the each of the two handles, which is detachably connected with the handheld end of the knife, the fork and the spoon, has an insertion notch.

Preferably, the fork comprises a first handheld plate which is rectangular and a fork-shaped part integrated with the first handheld plate, wherein the first handheld plate comprises two first flat plates integrated with each other, a first fold line is defined at a position where the two first flat plates are integrated with each other and is provided along a length direction of the two first flat plates, two first oblique fold lines are respectively defined at positions where a front end of the two first flat plates is connected with the fork-shaped part, the first fold line and the two first oblique fold lines are connected with each other and form a Y shape.

To be connected with the two handles, two free ends of the two first flat plates respectively have two first insertion openings; after being folded, the two first flat plates are overlapped with each other, the two first insertion openings are aligned with each other.

Preferably, the spoon comprises a second handheld plate which is rectangular and a flat deformable part integrated with the second handheld plate, wherein the second handheld plate comprises two second flat plates integrated with each other, a second fold line is defined at a position where the two second flat plates are integrated with each other and is provided along a length direction of the two second flat plates, two second oblique fold lines are respectively defined at positions where a front end of the two second flat plates is connected with the flat deformable part, the two second oblique fold lines are connected with each other and form a V shape, an end portion of the second fold line is connected with an end portion of the flat deformable part where the two second oblique lines are provided.

Similarly, in order to be connected with the two handles, two free ends of the two second flat plates respectively have two second insertion openings; after being folded, the two second flat plates are overlapped with each other, the two second insertion openings are aligned with each other.

Preferably, the fixing plate has a rectangular structure, the tableware suite further comprises a rectangular frame wrapped around outer edges of the fixing plate, wherein the rectangular frame comprises two side strips, a fixed end strip and a free end strip, wherein the two side strips and the fixed end strip are integrated with the fixing plate, the free end strip is hinged with an end of one of the two side strips, a free end of the free end strip is detachably connected with another of the two side strips.

The two side strips and the fixed end strip of the rectangular frame, three of which are integrated with the fixing plate, are perpendicular to the fixing plate and protrude from two surfaces of the fixing plate; all of the two side strips and the fixed end strip have a rectangular structure, a width of the two side strips and the fixed end strip is larger than a thickness of the fixing plate, so as to form blockage at the outer edges of the fixing plate.

Specifically, one end of one of the two side strips without connecting with the fixed end strip is flush with an end surface of the fixing plate, the end which is flush with the fixing plate is hinged with the free end strip.

Specifically, one end of another of the two side strips without connecting with the fixed end strip protrude from the end surface of the fixing plate, one section of the another of the two side strips which protrudes from the end surface of the fixing plate is defined to be a connection section, the free end of the free end strip is detachably connected with the connection section.

Preferably, the free end strip comprises a vertical end plate, a vertical side plate and a flat end plate three of which are integrated with each other, wherein the vertical end plate is perpendicular to the vertical side plate, both of the vertical end plate and the vertical side plate are perpendicular to the flat end plate; one end of the vertical end plate is hinged with the one of the two side strips, the flat end plate is corresponding to and flush with the end of the fixing plate without connecting with the fixed end strip; after the free end strip is connected with the connection section, an outer surface of the vertical end plate is flush with an outer surface of the connection section.

In order to accommodate the knife, the fork, the spoon and an end portion of the two handles which protrudes from the end of the fixing plate corresponding to the free end strip, there are three limit pieces on one surface of the flat end plate and two limit pieces on another surface of the flat end plate.

Preferably, each of the limit pieces comprise a limit vertical plate and a limit flat plate integrated with each other, wherein the limit vertical plate is perpendicular to the fixing plate, one end of the limit vertical plate is connected with the fixing plate, the limit flat plate is parallel to the fixing plate, an insertion slot is provided between the limit flat plate and the fixing plate; the T-shaped limit piece comprises a vertical arm and a limit top plate parallel to the two surfaces of the fixing plate integrated with each other, another two insertion slots are respectively provided among the vertical arm, the limit top plate and the fixing plate.

Preferably, each of the limit pieces comprise a limit vertical plate and a limit flat plate integrated with each other, wherein the limit vertical plate is perpendicular to the fixing plate, one end of the limit vertical plate is connected with the fixing plate, the limit flat plate is parallel to the fixing plate, an insertion slot is provided between the limit flat plate and the fixing plate.

Preferably, a handheld end of the fork has a third insertion opening.

Beneficial effects of the present invention are as follows. The fork and the spoon are foldable when in use and are flat while the fixing plate is fixed. The tableware such as flat knife, fork and spoon is fixed on the fixing plate, and then is stored in the box body; the fixing plate is easy to be put in or taken out of the box body. In the process of carrying, because the tableware is fixed by the limit part, the tableware will not contact each other, thereby avoiding the noise caused by mutual collision. Compared with the existing tableware suite, the tableware of the table suite provided by the present invention is fixed on the fixing plate, is compact in structure, occupies less space, so that the box body is small in size and the tableware is convenient to carry.

DETAILED DESCRIPTION OF THE PREFERRED EMBODIMENT

Figure 1:
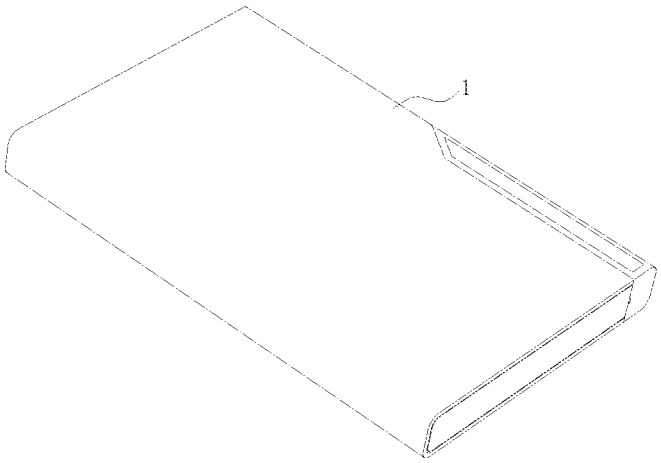
FIG. 1 is an assembly stereogram of a portable tableware suite having foldable and combinable tableware provided by the present invention.

In order to make those skilled in the art better understand the present invention, the present invention will be further described in detail with reference to the accompanying drawings and embodiments as follows.

As shown in FIGS. 1-4, a tableware suite having foldable and combinable tableware provided by the present invention is illustrated, which comprises a box body 1 having two openings at two ends thereof, a fixing plate 2 located within the box body 1 for limiting and avoiding tableware from moving in the box body, wherein the tableware comprising knives, forks and spoons is located on the fixing plate, at least one limit part is arranged on the fixing plate for engaging with the tableware.

According to the preferred embodiment, taking three kinds of tableware, namely, a knife 3, a fork 4 and a spoon 5 as an example. Accordingly, there are three limit parts on the fixing plate 2, namely, a first limit part 6 engaging with the knife, a second limit part 7 engaging with the fork and a third limit part 8 engaging with the spoon.

The fixing plate 2 is rectangular, and specifically, according to various shapes and sizes of the tableware, the layout of the tableware on the fixing plate is more compact, the knife 3 and the spoon 5 are arranged on one surface of the fixing plate 2, the fork 4 is arranged on another surface of the fixing plate 2; each of the first limit part 6 and the third limit part 8 comprises two limit pieces 9, two edges of each of the knife 3 and the spoon 5 are respectively inserted into the two limit pieces 9, that is, the two edges of the knife 3 are respectively inserted into the two limit pieces 9 of the first limit part 6, the two edges of the spoon 5 are respectively inserted into the two limit pieces 9 of the third limit part 8. The fork 4 is arranged on another surface of the fixing plate 2, the second limit part 7 also comprises two limit pieces 9, two edges of the fork 4 are respectively inserted into the two limit pieces of the second limit part. In order to better limit the knife 3, the fork 4 and the spoon 5, a knife-shaped sinking part 201, a fork-shaped sinking part 202 and a spoon-shaped sinking part 203 are respectively provided on two surfaces of the fixing plate 2 where the knife 3, the fork 4 and the spoon 5 are located.

To reduce the size of the tableware suite, it is necessary to combine the tableware as much as possible. According to the preferred embodiment, the tableware suite further comprises two square strip handles 10 which are detachably connected with a hand-held end of the knife 3, the fork 4 and the spoon 5. The handles 10 are able to be connected with the knife, the fork and the spoon for extending a handheld part of the tableware to easy to use, that is, in the design, the length of the knife 3, the fork 4 and the spoon 5 is able to be shortened, so as to facilitate storage and reduce the space required for storage.

There are two limit pieces 9 of the second limit part 7 on the another surface of the fixing plate, so as to fix the handles 10 on the fixing plate 2. A T-shaped limit piece 11 is arranged between the two limit pieces. The two limit pieces 9 and the T-shaped limit piece 11 are arranged in a row and form two fourth limit parts, the two handles 10 are arranged along a length direction of the fixing plate 2 and parallel to each other, two edges of each of the two handles 10 are respectively inserted into the two limit pieces 9 and the T-shaped limit piece 11 on the another surface of the fixing plate 2, that is, one of the two edges of the each of the two handles 10 is inserted into one of the two limit pieces 9, another of the two edges of the each of the two handles 10 is inserted into one side of the T-shaped limit piece 11. A distance between the T-shaped limit piece 11 and the two limit pieces 9 on the another surface of the fixing plate is basically equal to a width of the two handles, so that the two handles 10 are fixed to avoid the movement on the fixing plate 2, and it is convenient for placing and taking the two handles 10.

To be detachably connected with the knife 3, the fork 4 and the spoon 5, one end of each of the handles 10, detachably connected with the handheld end of the knife 3, the fork 4 and the spoon 5, has an insertion notch 1001.

Generally, it is rare to use the knife, the fork and the spoon at the same time while eating. The present invention discloses two handles 10, each of the handles 10 has the universal insertion notch 1001 for flexibly combining with the knife, the fork and the spoon, so as to save storage space while meeting the needs of users, thereby the fixing plate 2 and the box body 1 are smaller in volume and are easy to carry.

The knife 3 is flaky and is able to be connected with the handles 10 without folding, the knife 3 has an insertion opening for engaging with the insertion notch 1001 of the handles 10.

Figure 7:
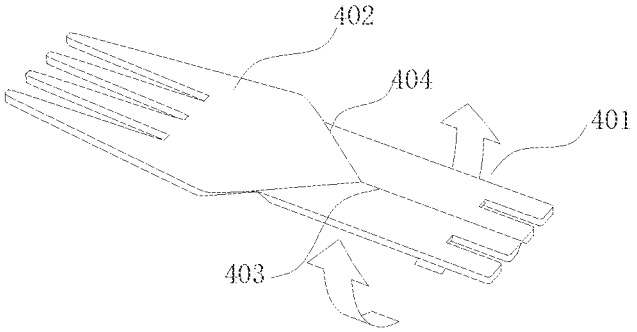
FIG. 7 is a stereogram of a fork of the portable tableware suite having foldable and combinable tableware provided by the present invention.

Referring to FIG. 7, the fork 4 comprises a first handheld plate 401 which is rectangular and a fork-shaped part 402 integrated with the first handheld plate 401, wherein the first handheld plate 401 comprises two first flat plates 401*a* integrated with each other, a first fold line 403 is defined at a position where the two first flat plates are integrated with each other and is provided along a length direction of the two first flat plates, two first oblique fold lines 404 are respectively defined at positions where a front end of the two first flat plates is connected with the fork-shaped part, the first fold line 403 and the two first oblique fold lines 404 are connected with each other and form a Y shape.

In order to be connected with the handles 10, two free ends of the two first flat plates respectively have two first insertion openings 401*b*. After being folded, the two first flat plates 401*a* are overlapped with each other, two first insertion openings 401*b* are overlapped with each other for engaging with the insertion notches 1001 of the two handles 10, as shown in FIG. 8.

Figure 9:
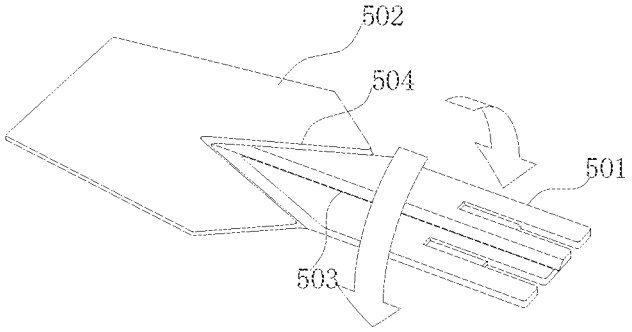
FIG. 9 is a stereogram of a spoon of the portable tableware suite having foldable and combinable tableware provided by the present invention.

Referring to FIG. 9, the structure of the spoon 5 is similar to that of the fork 4. The spoon 5 comprises a second handheld plate 501 which is rectangular and a flat deformable part 502 integrated with the second handheld plate 501, wherein the second handheld plate 501 comprises two second flat plates 501*a* integrated with each other, a second fold line 503 is defined at a position where the two second flat plates are integrated with each other and is provided along a length direction of the two second flat plates, two second oblique fold lines 504 are respectively defined at positions where a front end of the two second flat plates is connected with the flat deformable part 502, the two second oblique fold lines 504 are connected with each other and form a V shape, an end portion of the second fold line 503 is connected with an end portion of the flat deformable part where the two second oblique lines 504 are provided.

Figure 10:
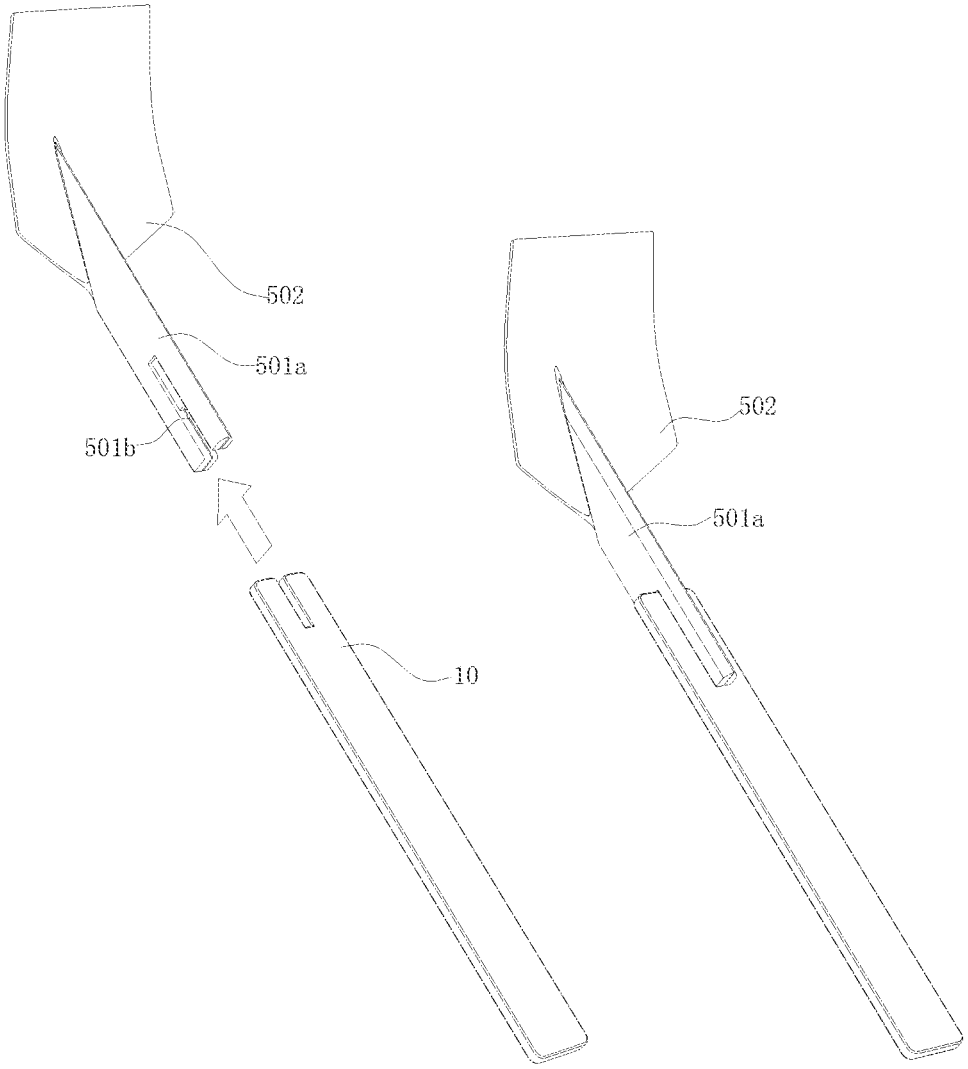
FIG. 10 is an assembly drawing of a spoon and a handle of the portable tableware suite having foldable and combinable tableware provided by the present invention.

Similarly, in order to be connected with the handles 10, two free ends of the two second flat plates respectively have two second insertion openings 501*b*. After being folded, the two second flat plates are overlapped with each other, the two second insertion openings are overlapped with each other for engaging with the insertion notches 1001 of the two handles 10. Due to the special shape, while being folded, the flat deformable part 502 will deform, as shown in FIG. 10.

Figure 8:
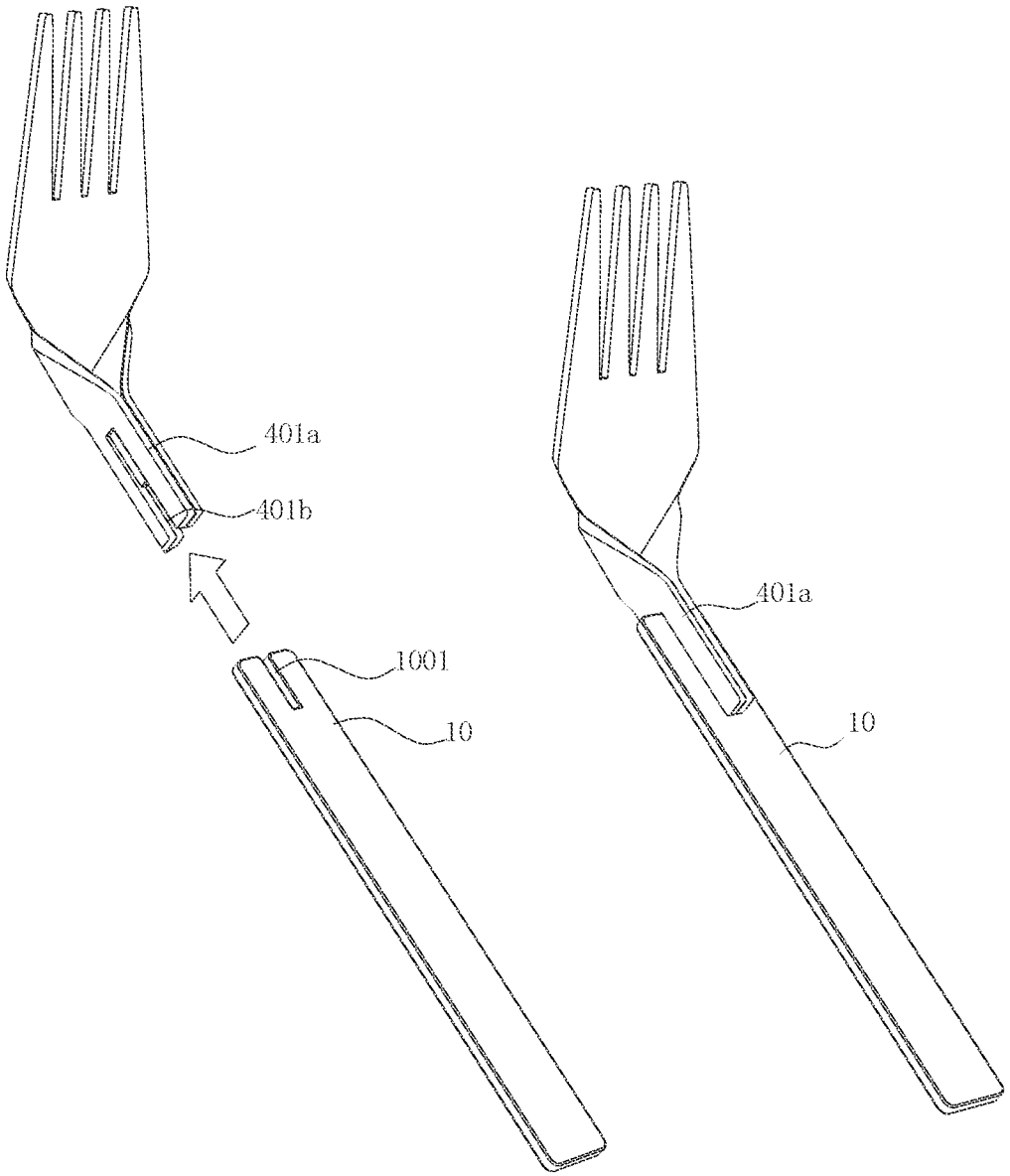
FIG. 8 is an assembly drawing of a fork and a handle of the portable tableware suite having foldable and combinable tableware provided by the present invention.

Referring to FIGS. 7-8, the fork 4, having a flat structure, the handheld end of the fork has a third insertion opening 301.

Figure 3:
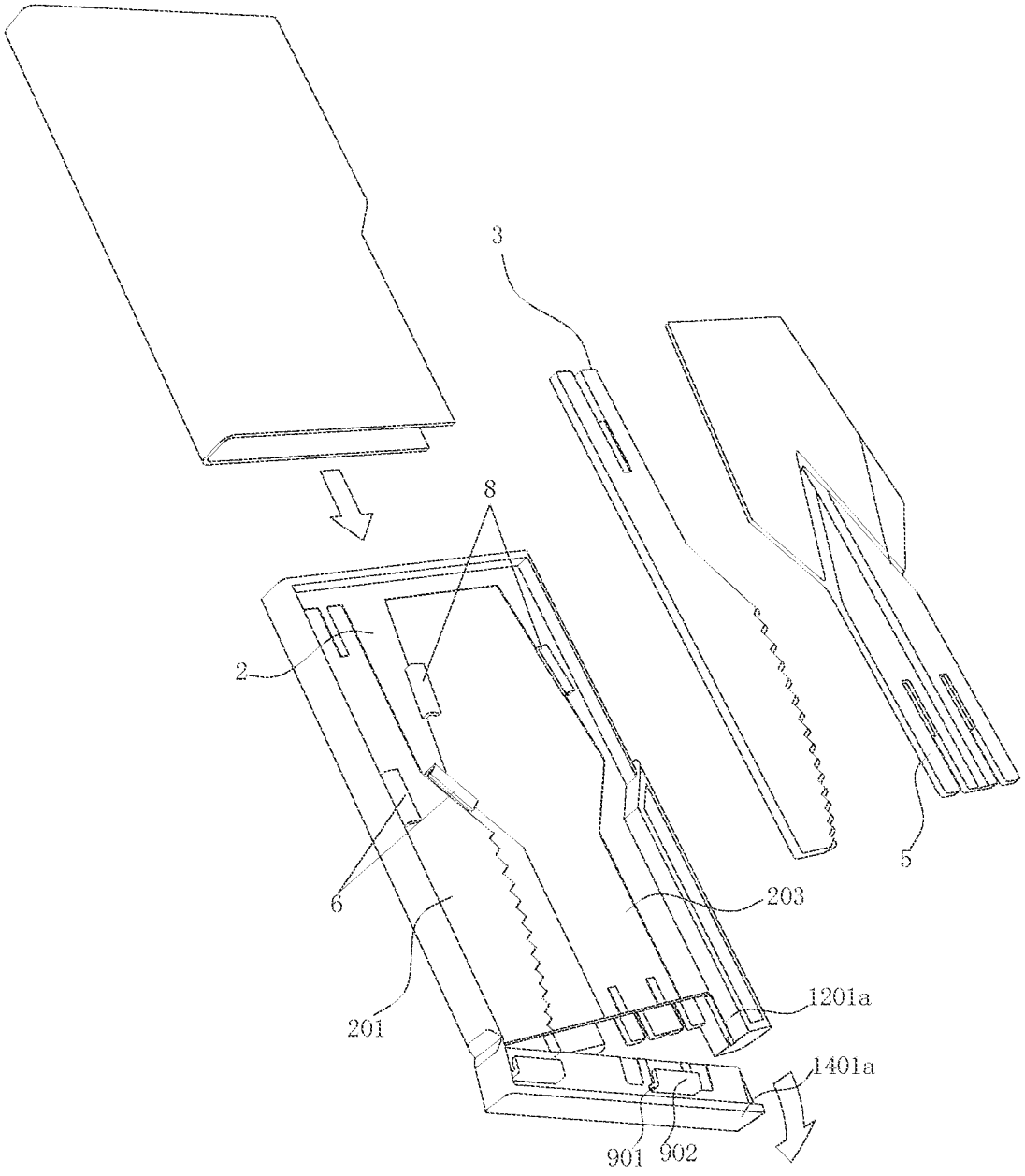
FIG. 3 is an exploded diagram of the portable tableware suite having foldable and combinable tableware provided by the present invention from one point of view.
Figure 4:
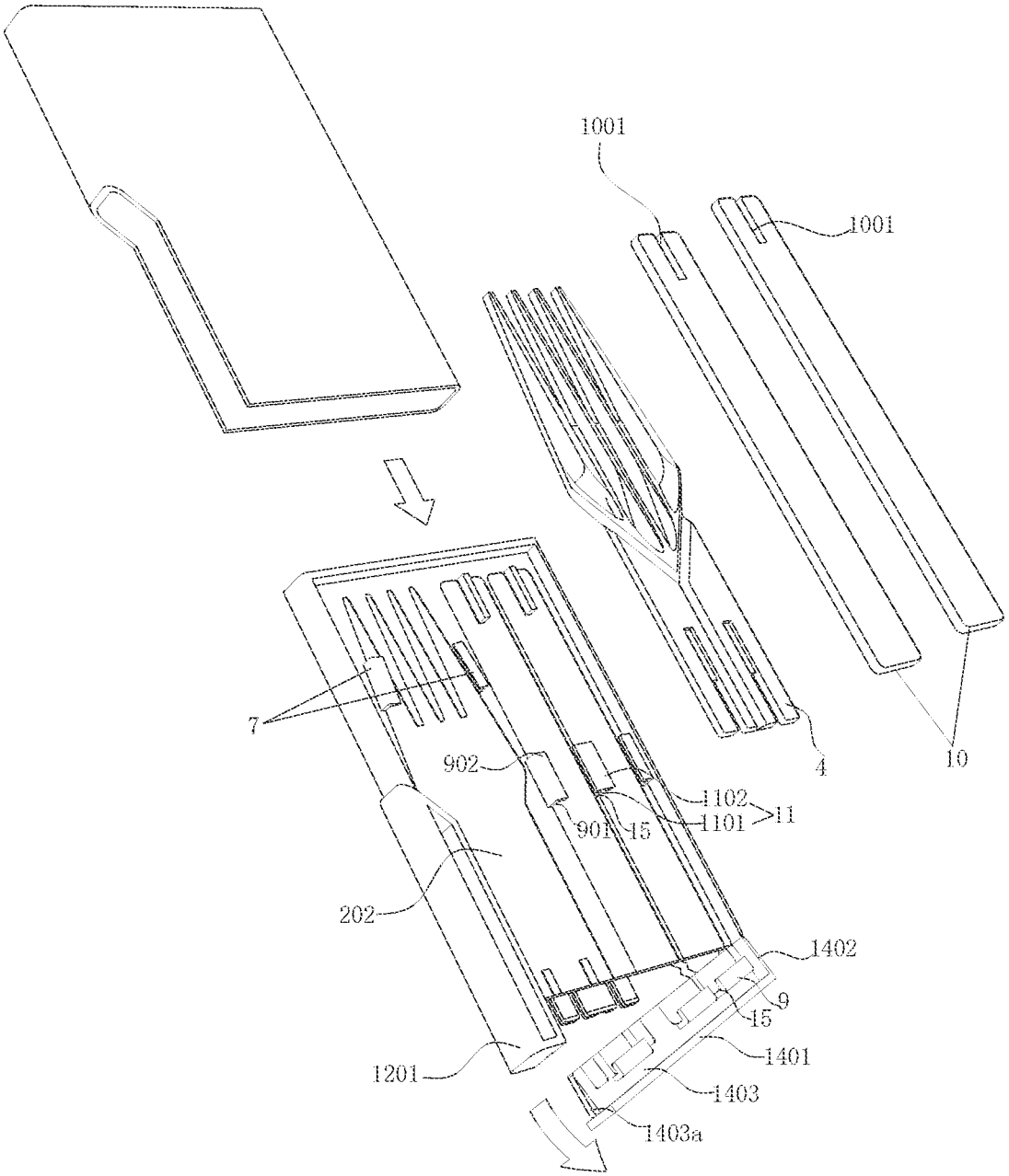
FIG. 4 is an exploded diagram of the portable tableware suite having foldable and combinable tableware provided by the present invention from another point of view.
Figure 5:
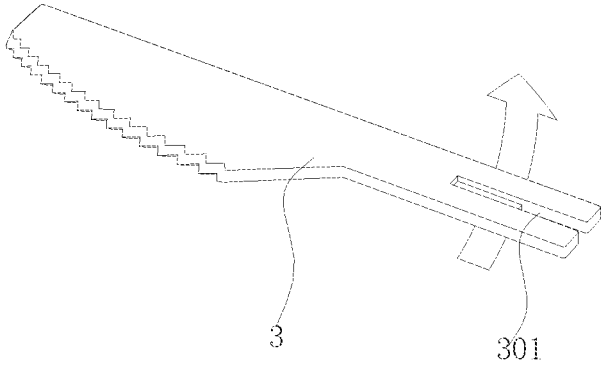
FIG. 5 is a stereogram of a knife of the portable tableware suite having foldable and combinable tableware provided by the present invention.
Figure 6:
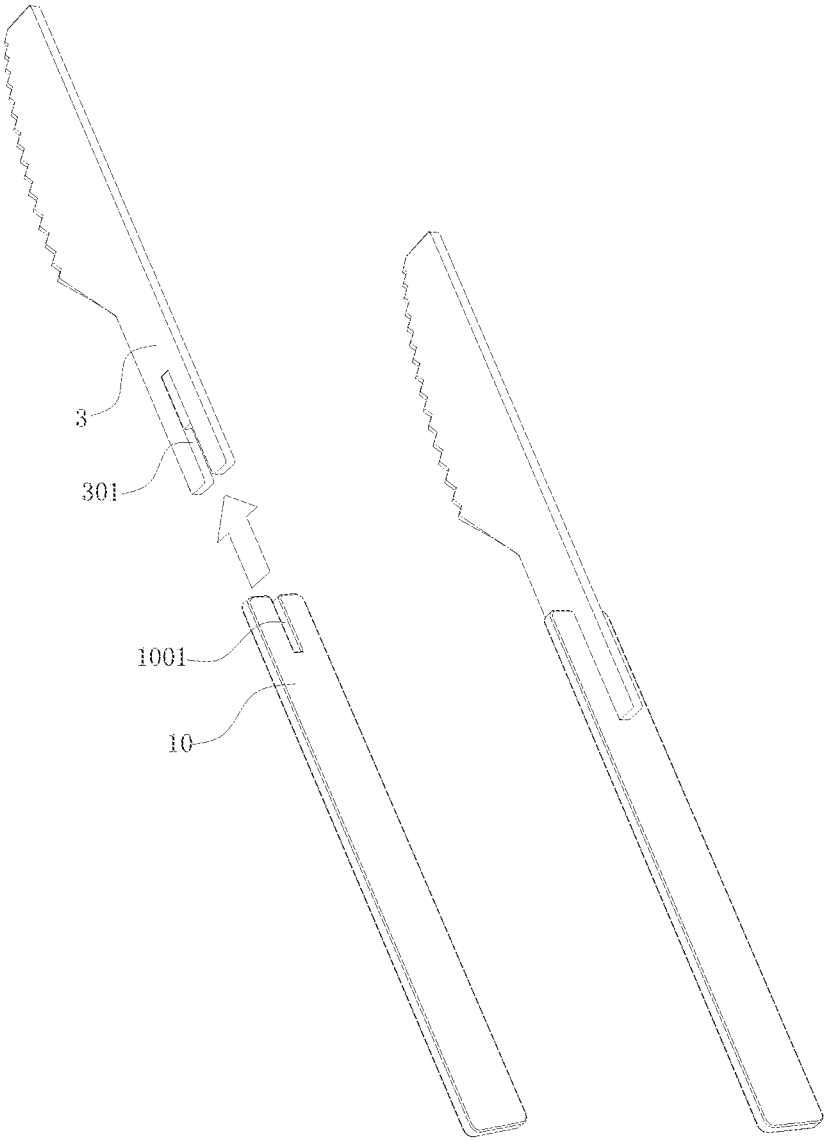
FIG. 6 is an assembly drawing of a knife and a handle of the portable tableware suite having foldable and combinable tableware provided by the present invention.

Referring to FIGS. 3 to 4, all of the limit parts 9 are same in structure and each of the limit parts 9 comprise a limit vertical plate 901 and a limit flat plate 902 integrated with each other, wherein the limit vertical plate is vertically connected with the fixing plate 2, the limit flat plate 902 is parallel to the fixing plate 2, an insertion slot 15 is provided between the limit flat plate 902 and the fixing plate 2; each of the limit parts 9, having a L-shaped structure, matches the tableware to be fixed as required and is arranged on two surfaces of the fixing plate 2 in an inverted L-shaped manner according to different angles. The T-shaped limit piece 11 comprises a vertical arm 1101 and a top plate 1102 parallel to the surface of the fixing plate 2 integrated with each other, two insertion slots 15 are respectively provided among the vertical arm 1101, the top plate 1102 and the fixing plate 2.

Figure 2:
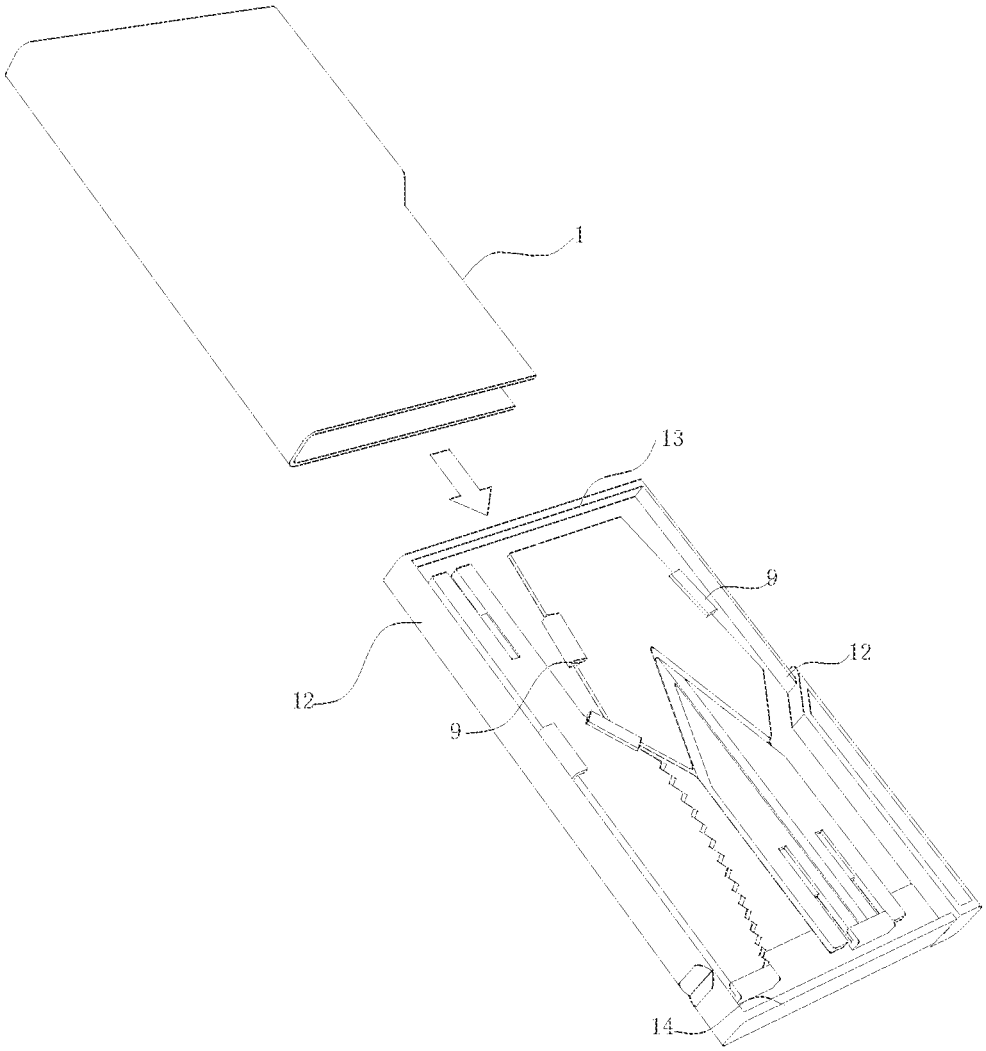
FIG. 2 is an exploded diagram of the portable tableware suite having foldable and combinable tableware provided by the present invention.

Referring to FIGS. 2 to 4, in order to better limit the tableware, and at the same time make the tableware fix on the two surfaces of the fixing plate 2 without being obtrusive, the tableware suite further comprises a rectangular frame wrapped around outer edges of the fixing plate 2. The square frame comprises two side strips 12, a fixed end strip 13 and a free end strip 14, wherein the two side strips 12 and the fixed end strip 13 are integrated with the fixing plate 2, the free end strip 14 is hinged with an end portion of one of the two side strips 12, a free end of the free end strip 14 is detachably connected with another of the two side strips 12. In FIG. 2, the end portion of the side strip located at a right side is hinged with the free end strip 14, the free end of the free end strip 14 is detachably connected with the strip located at a left side.

The fixed end strip 13 is integrated with an end surface of the fixing plate 2, the two side strips 12 are integrated with two side surfaces of the fixing plate 2.

Specifically, the two side strips 12 of the rectangular frame integrated with the fixing plate 2, and the fixed end strip 13 of the rectangular frame are perpendicular to the fixing plate; the two side strips 12 and the fixed end strip 13 protrude from the two surfaces of the fixing plate 2, that is, all of the two side strips 12 and the fixed end strip 13 are rectangular, a width between the two side strips 12 and the fixed end strip 13 is larger than a thickness of the fixing plate 2, so as to form blockage at the outer edges of the fixing plate 2.

One end of one of the two side strips 12 without connecting with the fixed end strip 13 is flush with another end surface of the fixing plate 2, the end which is flush with the fixing plate is hinged with the free end strip 14.

The another end surface of the fixing plate 2 refers to an end of the fixing plate 2 without connecting with the fixed end strip 13.

One end of another of the two side strips 12 without connecting with the fixed end strip 13 protrude from the another end surface of the fixing plate 2, one section of the another of the two side strips which protrudes from the end surface of the fixing plate is defined to be a connection section 1201, the free end of the free end strip 14 is detachably connected with the connection section 1201, the connection section 1201 has a transverse slot 1201*a* within an inner side along a length direction thereof.

Specifically, the free end strip 14 comprises a vertical end plate 1401, a vertical side plate 1402 and a fat end plate 1403 three of which are integrated with each other, wherein the vertical end plate is perpendicular to the vertical side plate, both of the vertical end plate and the vertical side plate are perpendicular to the limit fat plate; one end of the vertical end plate 1401 is hinged with the one of the two side strips 12, the limit fat plate 1403 is corresponding to and flush with the end of the fixing plate 2 without connecting with the fixed end strip 13; after the free end strip 14 is connected with the connection section 1201, an outer surface 1401*a* of the vertical end plate 1401 is flush with an outer surface of the connection section.

A clamping strip 1403*a* is provided at the free end of the top plate 1403 and integrated with the flat end plate 1403, the clamping strip 1403*a* cooperates with the transverse slot 1201*a* to avoid the free end of the free end strip 14 from falling off the connection section 1201.

In order to accommodate the knife 3, the fork 4, the spoon 5 and an end portion of the handles 10 which protrudes from the end of the fixing plate 2 corresponding to the free end strip, there are three limit pieces 9 on one surface of the flat end plate 1403 for respectively engaging with the fork 4 and an end portion of the two handles 10; there are two limit pieces 9 on another surface of the flat end plate 1403 for respectively engaging with an end portion of the knife 3 and the spoon 5.

Similarly, all of the limit pieces 9 are same in structure and each of the limit pieces 9 comprise a limit vertical plate 901 and a limit flat plate 902 integrated with each other, wherein one end of the limit vertical plate is vertically connected with the top plate 1403, the limit flat plate is parallel to the flat end plate 1403, an insertion slot 15 is provided between the limit flat plate and the top plate.

When in use, the free end of the free end strip 14 is pulled to be detached from the connection section 1201, and then one or more of the knife 3, the fork 4, and the spoon 5 are removed as required, and then the handles 10 are removed and assembled with the aforementioned tableware for usage.

The fork 4 and the spoon 5 are foldable and flat while being fixed on the fixing plate 2. While being used, the fork 4 and the spoon 5 are foldable. The flat knife 3, the fork 4 and the spoon 5 are fixed on the fixing plate 2, and then accommodated within the box body 1, the fixing plate 2 is easy to be put in or taken out of the box body. In the process of carrying, because the tableware is fixed by the limit parts, the tableware will not contact each other, which avoids noise caused by collision with each other; and moreover, the tableware will not move out of position, hindering the opening and closing of the box body. Compared with the existing tableware suite, the tableware of the table suite provided by the present invention is fixed on the fixing plate, is compact in structure, occupies less space, so that the box body is small in size and the tableware is convenient to carry.

Obviously, on the basis of this embodiment, one or more of the knife 3, the fork 4 and the spoon 5 is provided as required. Of course, on the basis of the above three tableware, other tableware such as chopsticks is able to be added. The specific method is obvious to those skilled in the art, and details are not described herein again.

Although the present invention has been described through above embodiments, those skilled in the art will recognize that the present invention has many modifications and changes without departing from the spirit of the present invention, and it is intended that the appended claims include such modifications and changes without departing from the present invention.

What is claimed is:

1. A portable tableware suite having foldable and combinable tableware, the tableware suite comprising:

a box body;

a fixing plate located within the box body for limiting and avoiding the tableware from moving in the box body;

the tableware, which is at least one member selected from the group consisting of a knife, a fork and a spoon, fixed on the fixing plate; and at least one limit part located on the fixing plate for engaging with the tableware, wherein:

the tableware comprises the knife, the fork and the spoon, there are three limit parts on the fixing plate which are respectively a first limit part for engaging with the knife, a second limit part for engaging with the fork and a third limit part for engaging with the spoon;

the tableware suite further comprises two rectangular strip handles which are detachably connected with a handheld end of the knife, the fork and the spoon;

there are two limit pieces and a T-shaped limit piece on another surface of the fixing plate where the second limit part is located for fixing the two handles, wherein the T-shaped limit piece is located between the two limit pieces on the another surface of the fixing plate, the two limit pieces and the T-shaped limit piece on the another surface of the fixing plate are arranged in a row and form two fourth limit parts, the two handles are parallel to each other, two edges of each of the two handles are respectively inserted into the two limit pieces and the T-shaped limit piece on the another surface of the fixing plate.

2. The portable tableware suite having foldable and combinable tableware according to claim 1, wherein one end of the each of the two handles, which is detachably connected with the handheld end of the knife, the fork and the spoon, has an insertion notch.

3. The portable tableware suite having foldable and combinable tableware according to claim 1, wherein the fork comprises a first handheld plate which is rectangular and a fork-shaped part integrated with the first handheld plate, wherein the first handheld plate comprises two first flat plates integrated with each other, a first fold line is defined at a position where the two first flat plates are integrated with each other and is provided along a length direction of the two first flat plates, two first oblique fold lines are respectively defined at positions where a front end of the two first flat plates is connected with the fork-shaped part, the first fold line and the two first oblique fold lines are connected with each other and form a Y shape.

4. The portable tableware suite having foldable and combinable tableware according to claim 3, wherein two free ends of the two first flat plates respectively have two first insertion openings; after being folded, the two first flat plates are overlapped with each other, the two first insertion openings are aligned with each other.

5. The portable tableware suite having foldable and combinable tableware according to claim 4, wherein a handheld end of the fork has a third insertion opening.

6. The portable tableware suite having foldable and combinable tableware according to claim 1, wherein the spoon comprises a second handheld plate which is rectangular and a flat deformable part integrated with the second handheld plate, wherein the second handheld plate comprises two second flat plates integrated with each other, a second fold line is defined at a position where the two second flat plates are integrated with each other and is provided along a length direction of the two second flat plates, two second oblique fold lines are respectively defined at positions where a front end of the two second flat plates is connected with the flat deformable part, the two second oblique fold lines are connected with each other and form a V shape, an end portion of the second fold line is connected with an end portion of the flat deformable part where the two second oblique lines are provided.

7. The portable tableware suite having foldable and combinable tableware according to claim 6, wherein two free ends of the two second flat plates respectively have two second insertion openings; after being folded, the two second flat plates are overlapped with each other, the two second insertion openings are aligned with each other.

8. The portable tableware suite having foldable and combinable tableware according to claim 1, wherein the fixing plate has a rectangular structure, the tableware suite further comprises a rectangular frame wrapped around outer edges of the fixing plate, wherein the rectangular frame comprises two side strips, a fixed end strip and a free end strip, wherein the two side strips and the fixed end strip are integrated with the fixing plate, the free end strip is hinged with an end of one of the two side strips, a free end of the free end strip is detachably connected with another of the two side strips.

9. The portable tableware suite having foldable and combinable tableware according to claim 8, wherein the two side strips and the fixed end strip of the rectangular frame, three of which are integrated with the fixing plate, are perpendicular to the fixing plate and protrude from two surfaces of the fixing plate, so as to form blockage at the outer edges of the fixing plate.

10. The portable tableware suite having foldable and combinable tableware according to claim 9, wherein one end of one of the two side strips without connecting with the fixed end strip is flush with an end surface of the fixing plate, the end which is flush with the fixing plate is hinged with the free end strip.

11. The portable tableware suite having foldable and combinable tableware according to claim 10, wherein one end of another of the two side strips without connecting with the fixed end strip protrude from the end surface of the fixing plate, one section of the another of the two side strips which protrudes from the end surface of the fixing plate is defined to be a connection section, the free end of the free end strip is detachably connected with the connection section.

12. The portable tableware suite having foldable and combinable tableware according to claim 9, wherein the free end strip comprises a vertical end plate, a vertical side plate and a flat end plate three of which are integrated with each other, wherein the vertical end plate is perpendicular to the vertical side plate, both of the vertical end plate and the vertical side plate are perpendicular to the flat end plate; one end of the vertical end plate is hinged with the one of the two side strips, the flat end plate is corresponding to and flush with the end of the fixing plate without connecting with the fixed end strip; after the free end strip is connected with the connection section, an outer surface of the vertical end plate is flush with an outer surface of the connection section.

13. The portable tableware suite having foldable and combinable tableware according to claim 12, wherein there are three limit pieces on one surface of the flat end plate and two limit pieces on another surface of the flat end plate.

14. The portable tableware suite having foldable and combinable tableware according to claim 13, wherein each of the limit pieces comprise a limit vertical plate and a limit flat plate integrated with each other, wherein the limit vertical plate is perpendicular to the fixing plate, one end of the limit vertical plate is connected with the fixing plate, the limit flat plate is parallel to the fixing plate, an insertion slot is provided between the limit flat plate and the fixing plate.

15. The portable tableware suite having foldable and combinable tableware according to claim 1, wherein each of the limit pieces comprise a limit vertical plate and a limit flat plate integrated with each other, wherein the limit vertical plate is perpendicular to the fixing plate, one end of the limit vertical plate is connected with the fixing plate, the limit flat plate is parallel to the fixing plate, an insertion slot is provided between the limit flat plate and the fixing plate; the T-shaped limit piece comprises a vertical arm and a limit top plate parallel to the two surfaces of the fixing plate integrated with each other, another two insertion slots are respectively provided among the vertical arm, the limit top plate and the fixing plate.

* * * * *